US011542669B2

(12) United States Patent
Meixner

(10) Patent No.: US 11,542,669 B2
(45) Date of Patent: Jan. 3, 2023

(54) SOIL WORKING ROLLER

(71) Applicant: Hamm AG, Tirschenreuth (DE)

(72) Inventor: Franz Meixner, Tirschenreuth (DE)

(73) Assignee: HAMM AG, Tirschenreuth (DE)

( * ) Notice: Subject to any disclaimer, the term of this patent is extended or adjusted under 35 U.S.C. 154(b) by 216 days.

(21) Appl. No.: 17/109,495

(22) Filed: Dec. 2, 2020

(65) Prior Publication Data

US 2021/0172127 A1 Jun. 10, 2021

(30) Foreign Application Priority Data

Dec. 4, 2019 (DE) ..... 10 2019 132 917.5

(51) Int. Cl.
*E01C 19/20* (2006.01)
*E01C 19/23* (2006.01)
*E01C 19/26* (2006.01)

(52) U.S. Cl.
CPC ..... *E01C 19/23* (2013.01); *E01C 19/26* (2013.01)

(58) Field of Classification Search
CPC ..... E01C 19/23; E01C 19/26
USPC ..... 404/113, 117
See application file for complete search history.

(56) References Cited

U.S. PATENT DOCUMENTS

| | | | | |
|---|---|---|---|---|
| 6,095,717 | A | 8/2000 | Kaldenberg et al. | |
| 8,727,660 | B2 * | 5/2014 | Anderegg | E02D 3/074 404/117 |
| 10,072,386 | B1 * | 9/2018 | Lehtola | B06B 1/186 |
| 2018/0171567 | A1 * | 6/2018 | Macdonald | F16F 15/223 |

FOREIGN PATENT DOCUMENTS

| | | |
|---|---|---|
| CN | 110512492 | 11/2019 |
| DE | 102014226373 | 6/2016 |
| EP | 0636746 | 2/1995 |
| EP | 3517684 | 12/2017 |
| FR | 5327 E | 3/1906 |
| WO | WO2017091912 | 6/2017 |

OTHER PUBLICATIONS

Extended European Search Report of Serial No. 20205347.6 dated Apr. 28, 2021, 9 pages.
German Search Report of Serial No. 10 2019 132 917.5 dated Sep. 8, 2020, 8 pages.

* cited by examiner

*Primary Examiner* — Raymond W Addie
(74) *Attorney, Agent, or Firm* — Rankin, Hill & Clark LLP

(57) ABSTRACT

A soil working roller for a soil processing machine, in particular a soil compactor, comprising a roller shell (44) extending longitudinally in a direction of a roller axis of rotation (D) and delimiting a roller interior (26), at least one ballast unit (46, 48) arranged in the roller interior (26), characterized in that each ballast unit (46, 48) comprises at least one ballast element (54) supported with respect of the roller shell (24) by means of an elastic suspension assembly (58), wherein the at least one ballast element (54) is permanently coupled to the roller shell (24) by the suspension assembly (58) and is movable with respect to the roller shell in the radial direction, axial direction, and circumferential direction, and/or a plurality of ballast units (46, 48) is provided in the roller interior (26) arranged in series in the circumferential direction, wherein each ballast unit (46, 48) comprises at least one ballast element supported with respect to the roller shell (24) by means of an elastic suspension assembly (58).

20 Claims, 2 Drawing Sheets

SOIL WORKING ROLLER

Figure 1:
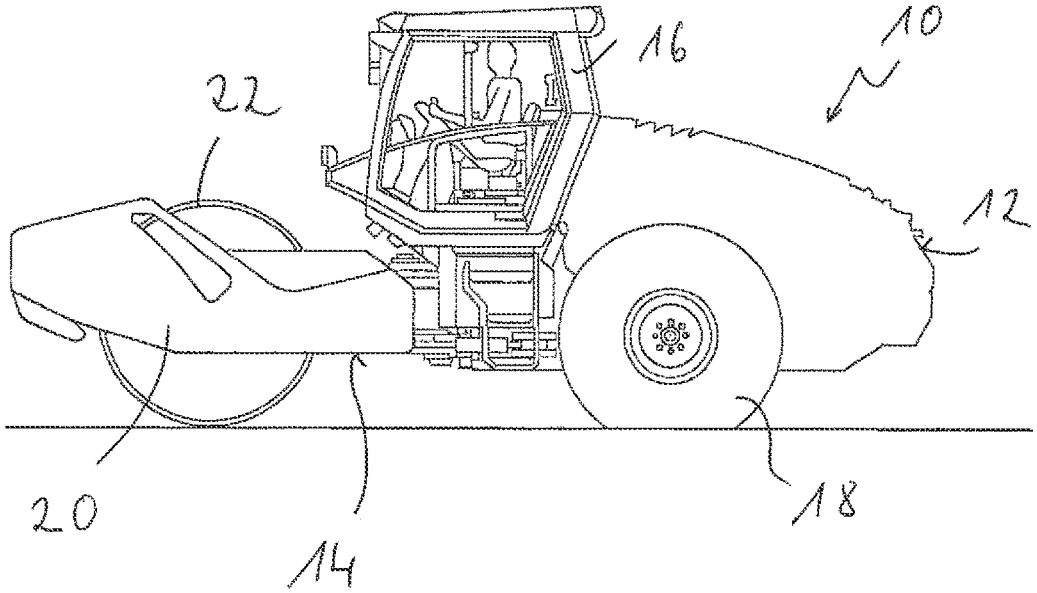

The present invention relates to a soil working roller for a soil processing machine, in particular a soil compactor, comprising a roller shell longitudinally extending in the direction of a roller axis of rotation and delimiting a roller interior and at least one ballast unit arranged in the roller interior.

A soil working roller of this type or a soil processing machine equipped with this type of soil working roller, for example, a soil compactor, is known from WO 2017/091912 A1.

In this known soil compactor, a ballast unit in the roller interior formed in a compacting roller is provided with one annular ballast element centrally arranged in a direction of a roller axis of rotation or two annular ballast elements each arranged in the roller interior in an axial end area of the roller shell. These annular ballast elements are radially supported with respect to the roller shell via a polyurethane layer lining the roller shell on its inner circumferential surface and providing a spring damping system. The annular ballast elements have a smaller outer diameter than an inner diameter of an inner circumferential surface provided by the polyurethane layer and radially supporting the ballast elements. The ballast elements are thus radially movable with respect to the roller shell and the polyurethane layer provided thereon, and may briefly lift up from the polyurethane layer during the occurrence of oscillations.

It is an object of the present invention is to provide a soil working roller for a soil processing machine, for example, a soil compactor, which has an increased mass while avoiding undefined movement states.

According to the invention, this problem is solved by a soil working roller for a soil processing machine, in particular a soil compactor, comprising:

- a roller shell longitudinally extending in a direction of a roller axis of rotation and delimiting a roller interior,
- at least one ballast unit arranged in the roller interior.

The soil working roller according to the invention is characterized in that:

- each ballast unit comprises at least one ballast element supported with respect to the roller shell by means of an elastic suspension assembly, wherein the at least one ballast element is permanently coupled to the roller shell by the suspension assembly and is movable with respect to the roller shell in the radial direction, axial direction, and circumferential direction, and/or
- a plurality of ballast units is provided in the roller interior arranged in series in the circumferential direction, wherein each ballast unit comprises at least one ballast element supported with respect to the roller shell by means of an elastic suspension assembly.

Due to the permanent coupling of a ballast element to the roller shell, which coupling still permits a movement in every spatial direction, a movement decoupling is guaranteed on the one hand between the roller shell and a ballast element in every spatial direction during the occurrence of unintentionally or deliberately resulting oscillating states of the roller shell during operation. On the other hand, it is ensured that a permanent suspension effect is provided by the suspension assembly, and thus a holding of a ballast element in a defined position with respect to the roller shell. Undefined movements of a ballast element in the interior of the roller shell may thus be excluded. The arrangement of a plurality of ballast units following one another in series in the circumferential direction at defined circumferential positions with respect to the roller shell also ensures that, due to the specification of defined circumferential positions for these types of ballast units, correspondingly defined relative positions of the ballast elements of these ballast units are specified with respect to the roller shell, in which positions the ballast elements, permanently coupled to the roller shell and thus moving, together with the same, in a defined way about the roller axis of rotation, may carry out a relative movement with respect to the roller shell due to the elastic effectiveness of the suspension assembly respectively assigned to the ballast elements.

In order to be able to most efficiently use the volume provided in the roller interior, for the at least one, preferably each ballast unit, the at least one ballast element may longitudinally extend in the direction of the roller axis of rotation and may have a circular ring segment-like cross-sectional contour.

For a defined positioning of each ballast element, it is proposed that, for at least one, preferably for each ballast unit, the suspension assembly at each axial end of the ballast element comprises a suspension unit fixed with respect to the at least one ballast element and with respect to the roller shell.

A stable suspension may thereby be guaranteed by the fact that at least one, preferably both suspension units comprise at least one suspension element fixed with respect to the at least one ballast element and the roller shell.

In particular in the case that the ballast elements have comparatively large masses, it is advantageous for a stable suspension if at least one, preferably both suspension units comprise a plurality of suspension elements.

A simple constructive configuration permitting in particular a movement in every spatial direction may be achieved by the fact that at least one, preferably each suspension element is constructed using elastomeric material, preferably rubber material, for example, as an elastomeric material block.

In order to be able to easily realize the coupling of one or more ballast units to the roller shell in a stable construction of the soil working roller, it is proposed that support elements are provided on the roller shell axially spaced apart from one another, and that for at least one, preferably each ballast unit, each of the two suspension units is fixed with respect to the roller shell via one of the support elements. These types of support elements may be designed, for example, like disks, and as so-called circular blanks are connected to the inner circumferential surface of the roller shell, for example by welding.

In order to be able to cause defined oscillating states during soil processing operation, for example, a defined vibration state of this type of soil working roller, it is proposed that an orbiting mass device is provided with at least one unbalanced mass assembly arranged in the roller interior and rotatable about an axis of unbalance.

The at least one unbalanced mass assembly may thereby comprise an unbalanced shaft, rotatable about the axis of unbalance, and at least one unbalanced mass supported on the unbalanced shaft and having a center of mass eccentric with respect to the axis of unbalance, wherein the unbalanced shaft may be rotatably supported on the support elements.

In particular for generating an oscillation acceleration oriented substantially orthogonal to the roller axis of rotation and acting on the compacting roller, the axis of unbalance may correspond to the longitudinal axis of the roller. Furthermore, the orbiting mass device may comprise an unbalanced drive assigned to the at least one unbalanced mass assembly for defined induction of the oscillating state.

The invention further relates to a soil processing machine, in particular a soil compactor, comprising at least one soil working roller constructed according to the invention.

Figure 2:
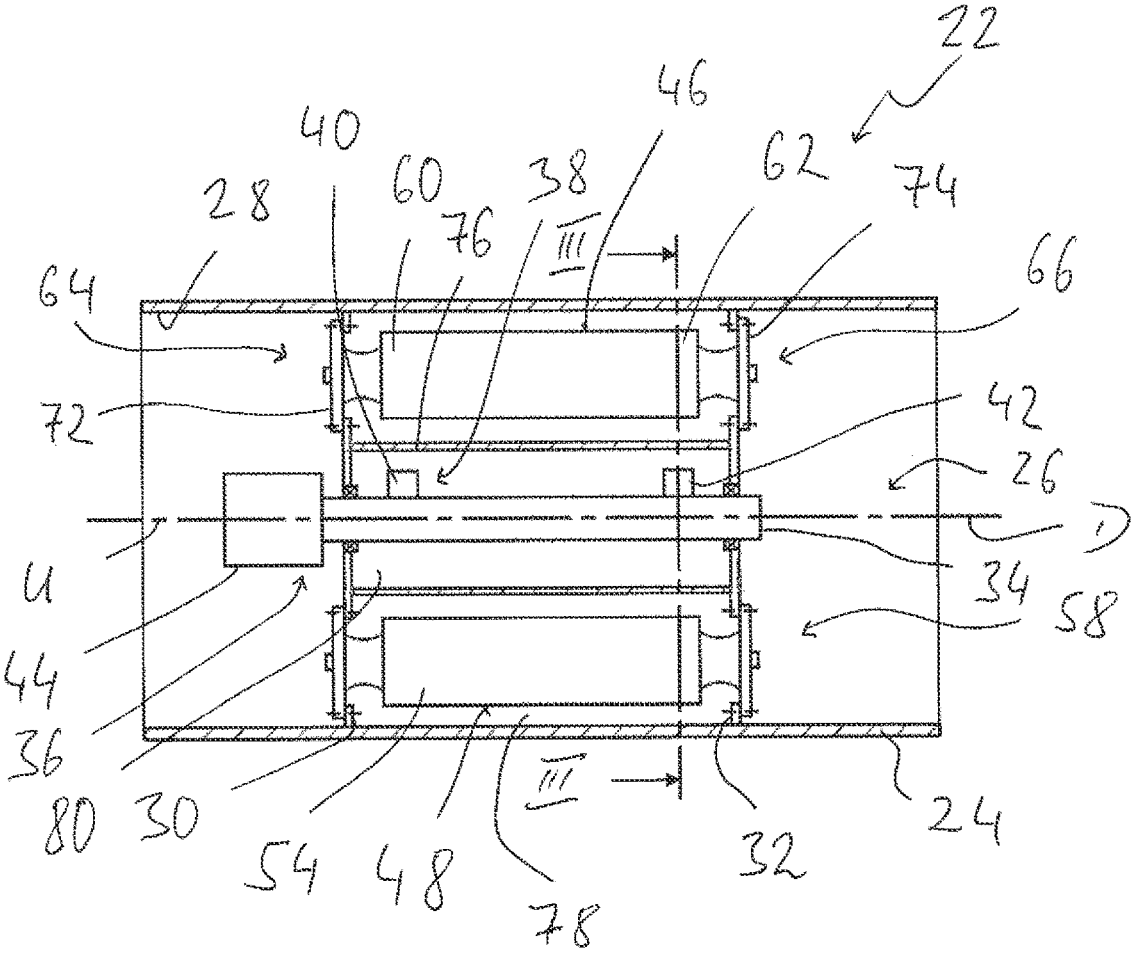
Figure 3:
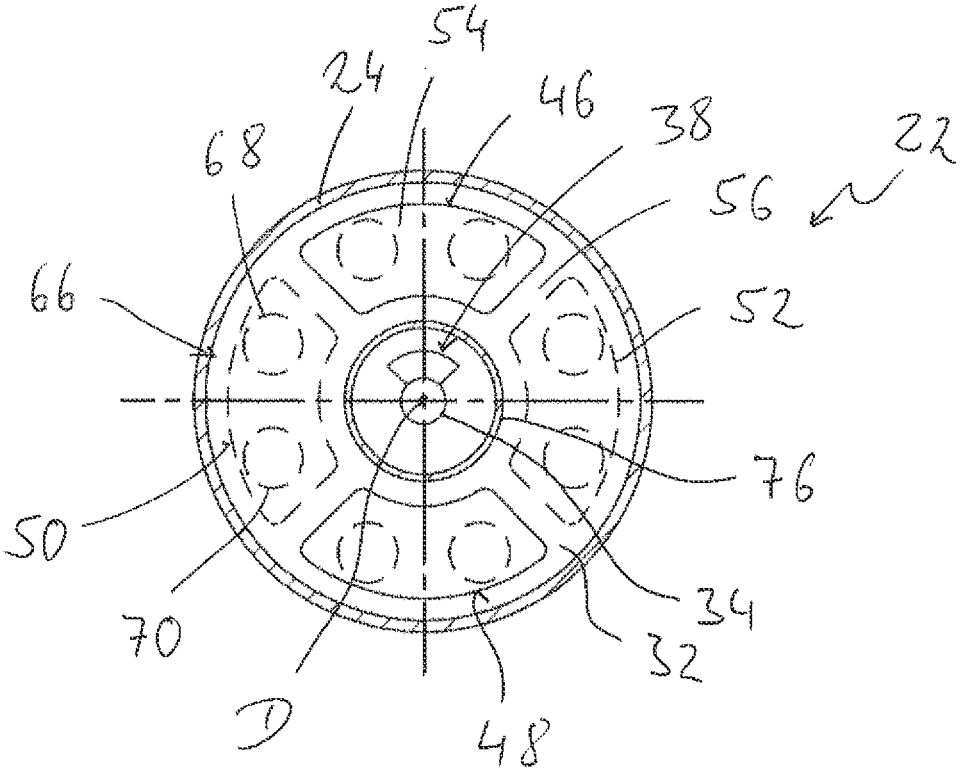

The present invention is subsequently described in detail with reference to the appended figures. As shown in:

FIG. 1 a side view of a soil compactor providing a soil processing machine;

FIG. 2 a longitudinal sectional view of a soil working roller, cut along a roller axis of rotation;

FIG. 3 a cross-sectional view of the soil working roller depicted in FIG. 2 along a line III-Ill in FIG. 2.

In FIG. 1, a soil processing machine 10 designed as a soil compactor is depicted in a side view. Soil processing machine 10 comprises a rear section 12 and a front section 14 pivotable about an approximately vertical axis with respect to rear section 12. A cabin 16 for an operator, a drive assembly (not shown), and drive wheels 18 on both sides of the drive assembly are provided on rear section 12. Front section 14 comprises a roller frame 20, on which a soil working roller 22, a compacting roller in the case of the configuration of soil processing machine 10 as a soil compactor, is rotatable about a roller axis of rotation orthogonal to the drawing plane of FIG. 1.

Soil working roller 22 is depicted in a longitudinal section, thus cut along roller axis of rotation D, in FIG. 2. Soil working roller 22 comprises a roller shell 24, which extends longitudinally in the direction of roller axis of rotation D and substantially cylindrically surrounds the same. Roller shell 24, generally constructed form metal material, surrounds a roller interior 26. Two disk-shaped support elements 30, 32 are arranged in roller interior 26 spaced axially apart from one another on an inner circumferential surface 28 of roller shell 24 and fixedly connected to roller shell 24 by welding. These two disks providing support elements 30, 32, also designated as round blanks, are arranged symmetrically with respect to a longitudinal center of roller shell 24 and support in their central area an unbalanced shaft 34 of an orbiting mass device, generally designated with 36, rotatable about roller axis of rotation D. Thus, roller axis of rotation D also forms an axis of unbalance U.

Orbiting mass device 36 further comprises an unbalanced mass assembly 38, which is fixedly connected to unbalanced shaft 34, for example, rotationally fixedly, thus for mutual rotation about axis of unbalance U or roller axis of rotation D, and which has two unbalanced masses 40, 42 arranged axially spaced apart from one another in the depicted example. Unbalanced masses 40, 42 provide as a whole a center of mass of unbalanced mass assembly 38 lying eccentrically with respect to axis of unbalance U. To generate a rotation of unbalanced shaft 34 about axis of unbalance U, an unbalanced drive 44 is provided, which may be designed, for example, as a hydraulic motor or as an electric motor. By rotating unbalanced shaft 34 about axis of unbalance U or roller axis of rotation D, an acceleration, orthogonally directed at roller axis of rotation D, generally designated as vibration, is exerted on compactor roller 22 or roller shell 24.

In order to be able to efficiently use the volume available in roller interior 26, a plurality of ballast units 46, 48, 50, 52 is provided in roller interior 26 of soil working roller 22. As illustrated in FIG. 3, two ballast units 46, 48 and two ballast units 50, 52 thereby lie diametrically opposite one another with respect to roller axis of rotation D, so that a center of mass lying on roller axis of rotation D is provided by ballast units 46, 48, 50, 52, and imbalances generated in rotational operation are prevented by ballast units 46, 48, 50, 52.

Ballast elements 54 of ballast units 46, 48, 50, 52 each have a circular ring segment-like cross-sectional contour and form as a whole an annular structure of ballast elements 54 surrounding roller axis of rotation D, wherein an intermediate space 56 is formed in each case in the circumferential direction between directly adjacent ballast elements 54.

Each of ballast units 46, 48, 50, 52 has an elastic suspension assembly 58 assigned to their ballast element 54. Ballast elements 54 are supported or suspended via these elastic suspension assemblies 58 in their two axial end areas 60, 62 on support elements 30, 32. Each suspension assembly 58, assigned to a ballast element 54 of a respective ballast unit 46, 48, 50, 52, comprises in each case a suspension unit 64, 66 assigned to each of the two axial end areas 60, 62 of ballast elements 54. Ballast elements 54 are supported or suspended via these suspension units 64, 66 on support elements 30, 32. Each of suspension units 64, 66 comprises in the depicted exemplary embodiment two suspension elements 68, 70 made form elastic material, for example, rubber material, and arranged spaced circumferentially apart from one another. These suspension elements, designed as material blocks, are, for example, fixedly connected, for example by screwing, to axial end areas 60, 62 of a respectively assigned ballast element 54 on the one side and to respective support parts 72, 74 on the other side, which may be fixedly connected, likewise by screwing, to assigned support elements 30, 32 on the other side. Unlike, for example, unbalanced shaft 34, ballast elements 54 of ballast units 46, 48, 50, 52 are therefore basically not supported to be rotatable in interior 26 of soil working roller 22.

Radially inward of the connection of ballast units 46, 48, 50, 52 to support elements 30, 32, a substantially cylindrical inner housing 76 surrounding roller axis of rotation D may be provided, and said housing may be connected to support elements 30, 32, for example by welding, in order to delimit a spatial area 78, radially outside of this inner housing 76 and between the same and roller shell 24, for accommodating ballast units 46, 48, 50, 52, and to delimit a spatial area 80 within inner housing 76 for accommodating unbalanced shaft 34 with unbalanced mass assemblies 38 thereon.

Each ballast unit 46, 48, 50, 52 forms, with its ballast element 54 and suspension units 64, 66, elastically supporting the same with respect to roller shell 24 via support elements 30, an oscillation system, in which, due the elastic deformability of suspension elements 68, 70, each ballast element 54 may basically move, with respect to roller shell 24, in every spatial direction, thus both in the direction of roller axis of rotation D as well as radially with respect to roller axis of rotation D and also in the circumferential direction about roller axis of rotation D. Thus, a decoupling is achieved between ballast elements 54 and roller shell 24, in particular also with respect to the periodic movement, in particular a vibration of roller shell 24, generated by orbiting mass device 36, so that ballast elements 54 do not oscillate with roller shell 24, but instead increase the total mass of soil working roller 22 by exploiting the volume available in roller interior 26 by lowering the center of gravity of a soil processing machine having this type of soil working roller 22. Ballast elements 54 are not visible from outside, so that demands on the visual appearance do not exist per se, and the visual field of the operator sitting in cabin 16 is not impaired. Ballast elements 54 may be constructed from inexpensive materials, e.g., concrete and/or steel. Suspension elements may be used, for example, for suspension elements 68, 70, which are also used in a similar way in order to elastically suspend this type of soil working roller 10 with respect to roller frame 22. Reference is made to the fact that a suspension of this type is not depicted in FIGS. 1 to 3; however, it may be provided axially on both sides of support elements 30, 32 or it may be coupled to these support elements 30, 32 via respective rotary decoupling bearings.

Because intermediate space 56, depicted in FIG. 3, is formed between ballast elements 54 of ballast units 46, 48, 50, 52, there is no risk that directly adjacent ballast elements 54 strike against one another during the occurrence of a relative movement of ballast elements 54 with respect to roller shell 24. In order to prevent an excessive movement or an excessive oscillation excitation during this relative movement in each oscillation system provided by a ballast unit 46, 48, 50, 52 of this type, it is advantageous to select the mass of ballast elements 54 on the one hand and the stiffness of suspension units 64, 66 on the other hand such that the resonance frequency of the oscillation systems thus constructed does not lie in a frequency range which corresponds to the oscillation frequency provided by orbiting mass device 36 for displacing soil working roller 22 into oscillation, in particular vibration, during operation. It may preferably be ensured that the resonance frequency of these oscillation systems comprising respective ballast units 46, 48, 50, 52 lies above or below the excitation frequency generated by orbiting mass device 36 or an excitation frequency range assigned to the same.

The invention claimed is:

1. A soil working roller for a soil processing machine, comprising:

a roller shell extending longitudinally in a direction of a roller axis of rotation and delimiting a roller interior, at least one ballast unit arranged in the roller interior, wherein each ballast unit comprises at least one ballast element supported with respect of the roller shell by an elastic suspension assembly, wherein the at least one ballast element is permanently coupled to the roller shell by the suspension assembly and is movable with respect to the roller shell in the radial direction, axial direction, and circumferential direction, and/or a plurality of ballast units is provided in the roller interior arranged in series in the circumferential direction, wherein each ballast unit comprises at least one ballast element supported with respect to the roller shell the elastic suspension assembly.

2. The soil working roller according to claim 1, wherein for at least one ballast unit, the at least one ballast element extends longitudinally in the direction of the roller axis of rotation and/or has a circular ring segment-like cross-sectional contour.

3. The soil working roller according to claim 2, wherein for at least one ballast unit, the suspension assembly at each axial end of the at least one ballast element comprises a suspension unit fixed with respect to the at least one ballast element and/or with respect to the roller shell.

4. The soil working roller according to claim 3, wherein at least one of the suspension units comprise at least one suspension element fixed with respect to the at least one ballast element and the roller shell.

5. The soil working roller according to claim 4, wherein at least one suspension element is constructed using elastomeric material.

6. The soil working roller according to claim 4, wherein at least one of the suspension units comprise a plurality of suspension elements.

7. The soil working roller according to claim 6, wherein at least one suspension element is constructed using elastomeric material.

8. The soil working roller according to claim 1, wherein for at least one ballast unit, the suspension assembly at each axial end of the at least one ballast element comprises a suspension unit fixed with respect to the at least one ballast element and/or with respect to the roller shell.

9. The soil working roller according to claim 8, wherein support elements are provided axially spaced apart from one another on the roller shell, and that for at least one ballast unit, each of the two suspension units is fixed with respect to the roller shell via one of the support elements.

10. The soil working roller according to claim 9, wherein the at least one unbalanced mass assembly comprises an unbalanced shaft, rotatable about the axis of unbalance, and at least one unbalanced mass supported on the unbalanced shaft and having a center of mass eccentric with respect to the axis of unbalance, and wherein the unbalanced shaft is rotatably supported on the support elements.

11. The soil working roller according to claim 8, wherein at least one of the suspension units comprise at least one suspension element fixed with respect to the at least one ballast element and the roller shell.

12. The soil working roller according to claim 11, wherein at least one suspension element is constructed using elastomeric material.

13. The soil working roller according to claim 11, wherein at least one of the suspension units comprise a plurality of suspension elements.

14. The soil working roller according to claim 13, wherein at least one suspension element is constructed using elastomeric material.

15. The soil working roller according to claim 14, wherein the elastomeric material is a rubber material.

16. The soil working roller according to claim 1, wherein an orbiting mass device is provided with at least one unbalanced mass assembly, arranged in the roller interior and rotatable about an axis of unbalance.

17. The soil working roller according to claim 16, wherein the at least one unbalanced mass assembly comprises an unbalanced shaft, rotatable about the axis of unbalance, and at least one unbalanced mass supported on the unbalanced shaft and having a center of mass eccentric with respect to the axis of unbalance.

18. The soil working roller according to claim 16, wherein the axis of unbalance corresponds to the longitudinal axis of the roller, and/or the orbiting mass device comprises an unbalanced drive assigned to the at least one unbalanced mass assembly.

19. A soil processing machine, comprising at least one soil working roller, comprising:

a roller shell extending longitudinally in a direction of a roller axis of rotation and delimiting a roller interior, at least one ballast unit arranged in the roller interior, wherein each ballast unit comprises at least one ballast element supported with respect of the roller shell by an elastic suspension assembly, wherein the at least one ballast element is permanently coupled to the roller shell by the suspension assembly and is movable with respect to the roller shell in the radial direction, axial direction, and circumferential direction, and/or a plurality of ballast units is provided in the roller interior arranged in series in the circumferential direction, wherein each ballast unit comprises at least one ballast element supported with respect to the roller shell the elastic suspension assembly.

20. The soil processing machine of claim 19, wherein the soil processing machine comprises a soil compactor.

* * * * *